US012312143B2

(12) United States Patent
Krenzia

(10) Patent No.: US 12,312,143 B2
(45) Date of Patent: May 27, 2025

(54) POUCH FOR A FOOD PRODUCT

(71) Applicant: Alka Global Ltd, Nicosia (CY)

(72) Inventor: Amir Krenzia, Tel-Aviv (IL)

( * ) Notice: Subject to any disclaimer, the term of this patent is extended or adjusted under 35 U.S.C. 154(b) by 67 days.

(21) Appl. No.: 18/109,842

(22) Filed: Feb. 14, 2023

(65) Prior Publication Data

US 2023/0192378 A1 Jun. 22, 2023

Related U.S. Application Data

(63) Continuation-in-part of application No. 16/910,070, filed on Jun. 24, 2020, now Pat. No. 11,577,899.

(30) Foreign Application Priority Data

Jun. 28, 2019 (CH) ..... 00867/19

(51) Int. Cl.
*B65D 75/58* (2006.01)
*B65D 65/40* (2006.01)
*B65D 75/50* (2006.01)

(52) U.S. Cl.
CPC ..... *B65D 75/5833* (2013.01); *B65D 65/40* (2013.01); *B65D 75/50* (2013.01)

(58) Field of Classification Search
CPC ..... B65D 65/40; B65D 75/00; B65D 75/008; B65D 75/50; B65D 75/52; B65D 75/527; B65D 75/58; B65D 75/5833; B65D 75/5883; B65D 85/72
USPC ..... 53/462
See application file for complete search history.

(56) References Cited

U.S. PATENT DOCUMENTS 3,032,251 A * 5/1962 Sigurd ..... B65D 75/50 229/116
3,094,269 A * 6/1963 Schneider ..... B65D 75/68 383/206
3,404,988 A * 10/1968 Anders ..... B65D 5/065 426/115
3,458,111 A * 7/1969 Leasure ..... B65D 75/5822 383/94
3,791,570 A * 2/1974 Hopkins ..... B65D 75/50 229/116

(Continued)

OTHER PUBLICATIONS

Openable Packaging Container, Mar. 28, 2013 (Year: 2013).*

*Primary Examiner* — Bryon P Gehman
(74) *Attorney, Agent, or Firm* — Outside General Counsel, LLP; Alexander Franco

(57) ABSTRACT

A tetrahedral-shaped pouch can be opened by tearing from a cut in a first lateral sealing edge and along a longitudinal sealing substantially perpendicular to the first lateral sealing edge to conveniently access non-liquid food contents, such as seeds or nuts. A short longitudinal cut can be made into but not all the way through the first lateral sealing edge, adjacent where the longitudinal sealing is positioned on the first lateral sealing edge. When opening the pouch, by initiating a tear starting at the cut, the packaging material will tear along, but not cross the longitudinal sealing, since the longitudinal sealing is formed from an overlapped and doubly thick section of packaging material. The pouch will therefore open, on at least one side of the tetrahedron, along a predictable tear line following the longitudinal sealing, to form a bowl-shaped receptacle from which the contained food product can be conveniently accessed.

20 Claims, 10 Drawing Sheets

(56) References Cited

U.S. PATENT DOCUMENTS

| | | | | |
|---|---|---|---|---|
| 6,581,764 | B1 * | 6/2003 | Hillebrand | B65D 75/5833 206/820 |
| 6,651,848 | B1 * | 11/2003 | Redmond | B65D 55/16 222/541.6 |
| 10,071,833 | B2 * | 9/2018 | Haedt | B65D 75/5805 |
| 10,196,192 | B2 * | 2/2019 | Gum | B65D 75/527 |
| 2012/0273530 | A1 * | 11/2012 | Erhard | B22D 17/04 222/591 |

* cited by examiner

POUCH FOR A FOOD PRODUCT

RELATED APPLICATIONS

The subject matter of this application is related to U.S. patent application Ser. No. 16/910,070, filed 2020 Jun. 24, now U.S. patent Ser. No. 11/577,899, and Switzerland Patent Application No. 00867/19, filed on 2019 Jun. 28, all of which are hereby incorporated by reference in their entireties.

BACKGROUND OF THE INVENTION

Pouches or bags for food products are known. The bags in the food packaging industry have to fulfill various tasks such as to keep the contents fresh and safe. Bags are made from various materials, mostly made from plastic and come in various sizes. On the one hand, products should be nicely designed so that those appear appealing to customers, but on the other hand, the products should be useful and functional. There are various designs and forms for food products. Most common bags are rectangular-shaped and include a front layer and a back layer wherein the front layer and the back layer are interconnected. Some have a wider base; others are identical at the top and bottom.

Pyramid-shaped tea bags are known and widely used. Such triangular pyramid shaped filter bags usually contain leaf teas and infusions. The pyramidal tea bags provide more room and thus enough space for the teas to fully unfold their flavor.

Tetrahedral packages or containers are used to include fluids such as milk or cream. GB865476A discloses a tetrahedron-shaped package of thin flexible material filled with liquid or fluent material. The package has a sealing fin extending along one edge of the tetrahedron, wherein adjacent to one of the corners of the tetrahedron package the sealing fin is provided with a transverse slit or notch extending across the major part of the width of the fin, from and inclined to the edge of the fin, in a direction substantially perpendicular to the axis or median line of an apex of the package corner, whereby to facilitate tearing off of the end portion of the fin and the corner of the package adjacent thereto, and thus to form an open pouring aperture in the corner of the package, of substantially circular shape. The aperture is intentionally small as the package is for liquids.

In GB865475A improvements in and relating to sealed packages are described. Disclosed is a tetrahedron-shaped package with a rip-cord or zip-string that extends inside the package, wherein each end of the cord or string is and embedded in, and sealed off by, a sealing fin of the material forming the package. The cord or string is pre-treated to prevent escape of packaged materials therethrough by a "wicking" action. An additional rip-cord or zip-string is needed within this package.

There is a general need for advancements in this field of technology.

SUMMARY OF THE INVENTION

A tetrahedral-shaped pouch can be opened by tearing from a cut in a first lateral sealing edge and along a longitudinal sealing substantially perpendicular to the first lateral sealing edge to conveniently access non-liquid food contents, such as seeds, nuts, or cereal. During a production and/or packaging process, the longitudinal edge sections of an elongated sheet of packaging material can be brought together, overlapped, and sealed to form an elongated or continuous tube of packaging material extending along a longitudinal axis. The overlapped and sealed edge sections are referred to herein as the longitudinal sealing. Individual pouches can be formed by heat sealing the tube across a lateral axis a predetermined length from a previously cut edge of the tube. The tube can be cut laterally across its width adjacent the heat seal to form one lateral sealing edge of a resulting pouch. Product can be introduced into the pouch before, during or after the lateral cutting that forms the pouch. The previously cut edge opposite the one lateral sealing edge is then also heat sealed along an orthogonal to both the one lateral sealing edge and the longitudinal axis of the tube to form another lateral sealing edge of a roughly tetrahedral-shaped pouch.

When forming the pouch, the longitudinal sealing can be positioned in a predetermined location along a length of a first of the lateral sealing edges. A short longitudinal cut can be made into but not all the way through the first lateral sealing edge, adjacent where the longitudinal sealing is positioned on the first lateral sealing edge. When opening the pouch, by initiating a tear starting at the cut, the packaging material will tear along, but not cross the longitudinal sealing, since the longitudinal sealing is formed from an overlapped and doubly thick section of packaging material. The pouch will therefore open, on at least one side of the tetrahedron, along a predictable tear line following the longitudinal sealing, to form a bowl-shaped receptacle from which the contained food product can be conveniently accessed.

A pouch for a food product can include a side wall comprising a tubular section of material that has been formed by bringing together, overlapping and sealing together longitudinal edge sections of a sheet of packaging material to form a longitudinal sealing; a first sealing edge extending laterally across a first flattened and cut end section of the tubular section of material and arranged substantially orthogonally to the longitudinal sealing; a second sealing edge extending laterally across a second flattened and cut end section of the tubular section of material opposite the first flattened and cut end section of the tubular section of material, the second sealing edge arranged substantially orthogonally to the first sealing edge and to the longitudinal sealing; a notch in the first sealing edge adjacent the longitudinal sealing; and a tear area for generating an opening starting from the notch in the first sealing edge and having one border extending substantially along the longitudinal sealing.

The pouch can be pyramidal shaped and asymmetric. The pouch after opening can form a bowl-shaped receptacle that provides access to the food product. The longitudinal sealing can be folded away from the tear area. The longitudinal sealing can be arranged asymmetrically. The longitudinal sealing can extend between the first sealing edge and the second sealing edge, the longitudinal sealing being substantially near to a pouch side edge. The pouch can be tetrahedral shaped. The notch can be arranged near the longitudinal sealing and can extend approximately one third into an area extending from the first sealing edge. The notch can be arranged opposite of the longitudinal sealing towards a longitudinal middle of the first sealing edge. The tear area can extend substantially parallel to the longitudinal sealing. The pouch can further include a force insertion area substantially near to an apex at a side of the first sealing edge where the longitudinal sealing intersects.

In between the first sealing edge and the second sealing edge, the tear area can extend along a line to generate a tear edge substantially near and along the longitudinal sealing.

The side wall can include a material that is multi-layered and heat sealable. The side wall can be formed at least in part of aluminum. The opening can be substantially in a shape of an isosceles triangle. The opening can run from the first sealing edge to substantially an inner part of the second sealing edge. The opening can run slightly oblique from the first sealing edge being vertically arranged to the second sealing edge being horizontally arranged when the pouch is placed on a horizontal plane. The opening can be configured to release approximately one half of a side length of the second sealing edge. The pouch after opening can include a tear-off part with a substantially rectangular shape and a triangular end.

A method for producing pyramidal shaped pouches for receiving a food product can include: providing a quadrilateral base of a multi-layered heat sealable material and forming a tube from the material; sealing along a longitudinal direction where the material overlaps to form a longitudinal sealing; sealing across the tube to generate a first sealing edge, the first sealing edge being a first sealing edge for both of two adjacent pouches; sealing across the tube to generate a second sealing edge substantially orthogonally to the first sealing edge, the second sealing edge being a second sealing edge for one of the two pouches; sealing across the tube to generate a third sealing edge substantially orthogonally to the first sealing edge, the third sealing edge being a second sealing edge for another of the two pouches; creating a notch in the first sealing edge adjacent the longitudinal sealing to form a tear area for generating an opening on each of the two adjacent pouches, the tear area extending substantially along the longitudinal sealing; and cutting laterally along the first sealing edge to separate the two adjacent pouches.

A pouch for a food product includes a side wall comprising a tubular section of heat-sealable laminate material having a tear characteristic; a first sealing edge extending laterally across a first flattened and cut end section of the tubular section of material; a second sealing edge extending laterally across a second flattened and cut end section of the tubular section of material opposite the first flattened and cut end section of the tubular section of material, the second sealing edge arranged substantially orthogonally to the first sealing edge; a notch in and running substantially perpendicular to the first sealing edge to facilitate tearing the pouch starting at the first sealing edge and along two lower tear edges in the side wall to form, based on the tear characteristic and a position of the notch within the first sealing edge, a substantially triangular tear area in the side wall having an apex at the first sealing edge and a base extending along a resulting fold extending between an end of each lower tear edge in the side wall, the tearing of the pouch generating a tear off part including a portion of the side wall and a portion of the first sealing edge adjacent the notch, the tear off portion having a substantially triangular tear area with an apex at the notch in the first sealing edge and extending along two upper tear edges in the side wall to meet the base extending along the resulting fold, the upper and lower tear edges being complimentary and formed by tearing the pouch.

The pouch after opening can form a bowl-shaped receptacle that provides access to the food product. The pouch can be tetrahedral shaped. The side wall can include a material that is multi-layered and heat sealable. The side wall can include aluminum. The tear area can be substantially in a shape of an isosceles triangle. The tear area can run from the first sealing edge to substantially an inner part of the second sealing edge. The tear area can run slightly oblique from the first sealing edge being vertically arranged to the second sealing edge being horizontally arranged when the pouch is placed on a horizontal plane. The tear area can release approximately one half of a side length of the second sealing edge. The tear off part can be substantially tetrahedral in shape.

The tubular section of heat-sealable laminate material can be formed by bringing together, overlapping and sealing together longitudinal edge sections of a sheet of packaging material to form a longitudinal sealing; the first sealing edge can be arranged substantially orthogonally to the longitudinal sealing; the second sealing edge can be arranged substantially orthogonally to the longitudinal sealing; and the notch in the first sealing edge can be adjacent the longitudinal sealing.

The longitudinal sealing can be folded away from the tear area. The longitudinal sealing can be arranged asymmetrically. the longitudinal sealing can extend between the first sealing edge and the second sealing edge, the longitudinal sealing being substantially near to a pouch side edge. The notch can be arranged near the longitudinal sealing and can extend approximately one third into an area extending from the first sealing edge. The notch can be arranged opposite of the longitudinal sealing towards a longitudinal middle of the first sealing edge. The tear area can extend substantially parallel to the longitudinal sealing.

The pouch can further include a force insertion area substantially near to an apex at a side of the first sealing edge where the longitudinal sealing intersects.

In between the first sealing edge and the second sealing edge, the tear area can extend along a line to generate a tear edge substantially near and along the longitudinal sealing.

BRIEF DESCRIPTION OF THE DRAWINGS

In order to facilitate better understanding of the present invention, reference is made below to the drawings. These show only exemplary embodiments of the subject matter of the invention.

In the figures and the associated description, identical or functionally analogous parts are provided with the same reference numerals.

DETAILED DESCRIPTION

Figure 1:
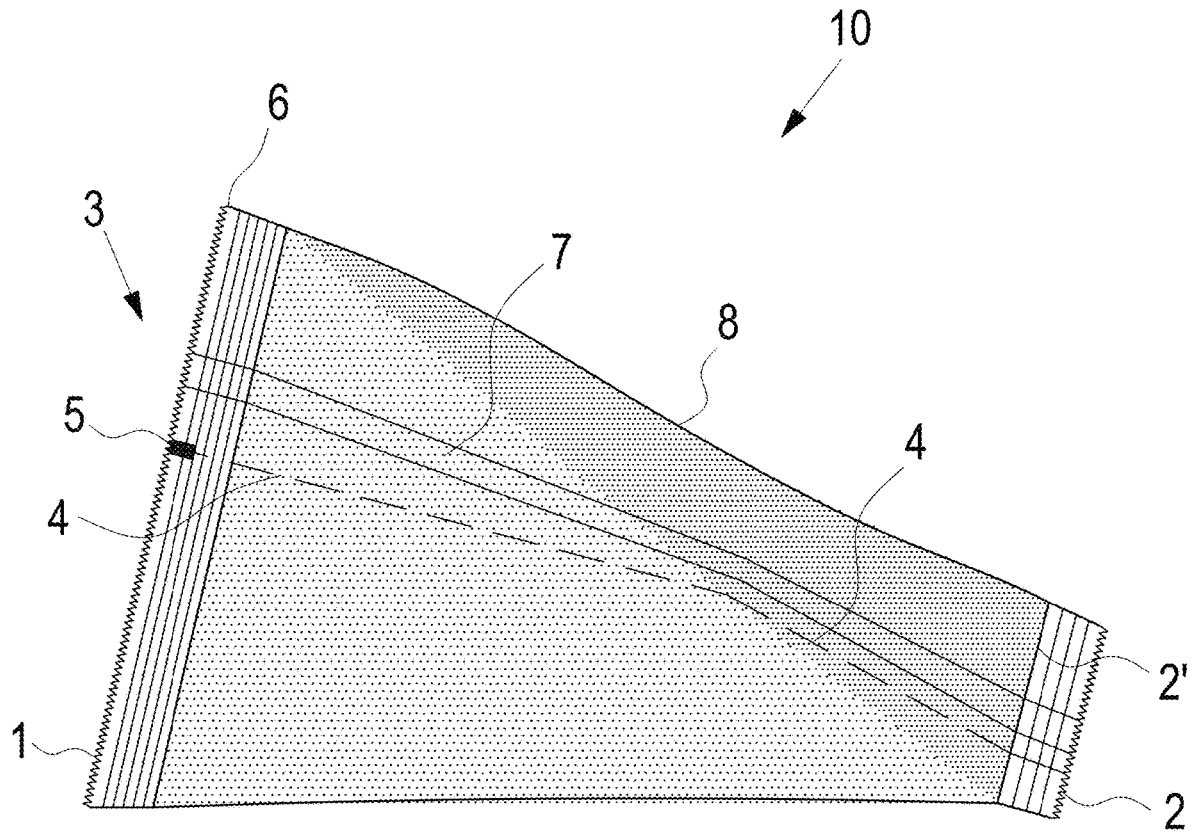
FIG. 1 shows a schematic representation of a pyramidal shaped pouch.

FIG. 1 shows a tetrahedral or pyramidal shaped pouch 10 formed from a tube of packaging material and suitable for a food product. During a production and/or packaging process, the longitudinal edge sections of an elongated sheet of packaging material can be brought together, overlapped, and sealed to form an elongated or continuous tube of packaging material extending along a longitudinal axis. The overlapped and sealed edge sections can be referred to as a longitudinal sealing or a seam. The three-dimensional pouch 10 can include a first sealing edge 1 and a second sealing edge 2 which can be arranged substantially orthogonally to each other to form the pouch 10 from the tube of packaging material. The pouch 10 has a tear area 4, 5 extending substantially along a longitudinal sealing 7 for generating an opening 9 (shown in FIG. 4). The first sealing edge 1 is arranged in a vertical direction whereas the second sealing edge 2 is in a horizontal direction, both are substantially perpendicular to each other. The vertical sealing at the first sealing edge 1 has a defined width that forms a vertical fin to keep the pouch 10 closed. The horizontal sealing at the second sealing edge 2 has also a defined width that forms a horizontal fin to keep the pouch 10 closed on the other side. The fins on both sides have preferably the same or an identical width. The tear open element comprises a notch 5 that is formed within the first sealing edge 1, i.e. into the vertical fin. The notch 5 is basically a cut or slit that is generated during the production process of the pouch 10. The notch 5 forms a recess that extends preferably orthogonally into the material of the pouch 10.

The slit or notch 5 extends approximately one third from the first sealing edge 1 into the vertical fin. The notch 5 provides a direction into which tensile forces act when opening the pouch 10. The notch 5 might run deeper into the material, i.e. the vertical sealing, to provide more or better guidance.

The notch 5 can be arranged near or adjacent the longitudinal sealing 7, i.e. where the pouch 10 is sealed or welted. The material is here "folded right over left" and thus is thicker than in other parts. The notch 5 can be advantageously arranged opposite of the longitudinal sealing 7 towards the longitudinal middle of the first sealing edge 1.

The pouch 10 can be produced from a material that is multi-layered and heat sealable. The material can be printable on the outside and may have instructions printed thereon for a consumer to indicate how to open the pouch 10 properly. This flexible material can include aluminum to guarantee a certain stiffness and/or gas impermeability so as to keep the contents fresh. Common plastic pouches would not fulfill that requirement as such a material would be too soft. On the other hand, the use of tetra pack materials would be too tight.

The longitudinal sealing 7 can extend from the first sealing edge 1 to the second sealing edge 2. The longitudinal sealing 7 can be substantially close to, adjacent or near to a pouch side edge 8. The longitudinal sealing 7 need not be centered to ensure opening of the pouch 10 through guidance starting from the tear notch 5 and going straight along the tear edge 4 near the sealing 7 slightly inclined to the bottom of the pouch 10, i.e. to the second sealing edge 2.

Along one of its sides, the tear area 4, 5 can extend substantially parallel to and along the longitudinal sealing 7.

In between the first sealing edge 1 and the second sealing edge 2 the tear area 4, 5 extends as tear edge 4 along a virtual line (dashed line in FIG. 1) near where the pouch is sealed. As the material is thicker along the longitudinal sealing 7, the tear edge 4 will not run into the thicker part and is thus guided along the longitudinal sealing 7.

The pouch 10 can include a force insertion area 3 substantially near to an apex 6 at the side of the first sealing edge 1 where the longitudinal sealing 7 intersects. This is one holding area for the consumer whereas the other holding area for opening the pouch 10 is intuitive or direct near the notch 5 on the other side.

The opening 9 (shown in FIG. 4) that is to be created though tensile or pulling forces runs from the first sealing edge 1 along the tear edge 4 to substantially an inner part 2' of the second sealing edge 2, i.e. the horizontal fin. The opening 9 can be stopped before reaching the inner part 2' so that for example only have of the opening 9 is released. Any size of opening 9 can be generated by applying appropriate forces or by mechanical means such as thickened material at a location where a stop is desired.

Figure 2:
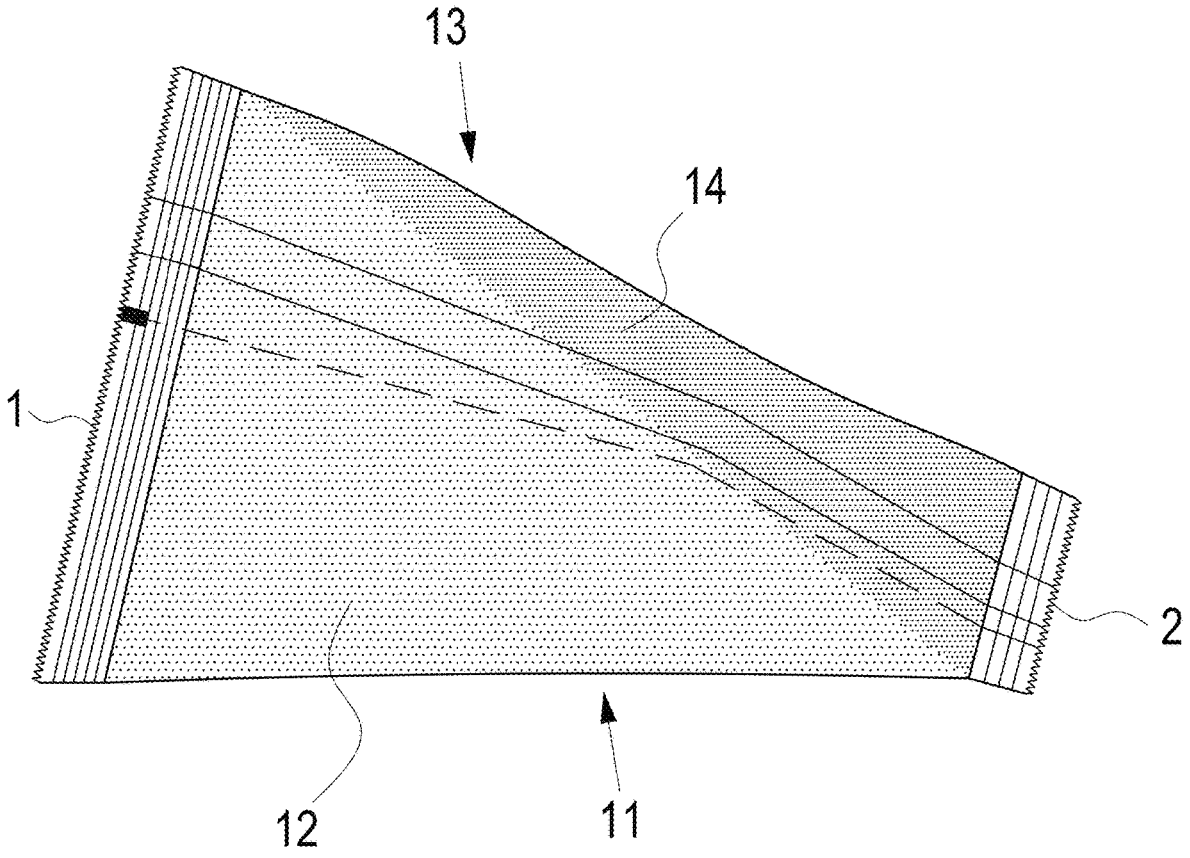
FIG. 2 shows a further schematic representation of the pyramidal shaped pouch.

FIG. 2 illustrates some geometrical aspects of the pouch 10 The pyramidal shaped pouch 10 is arranged or placed horizontally, e.g. on a plane, table or the like (not shown).

The pouch 10 can include at the bottom a first triangular plane 11, on one side a second triangular plane 12 and on the other side a third triangular plane 13, and an inclined fourth triangular plane 14 running from the top of the vertically oriented first sealing edge 1 to the horizontally oriented second sealing edge 2. All planes 11, 12, 13, 14 merge into each other without forming strict edges. There is a smooth fading from one plane into another plane. In other words, the triangular planes form isosceles triangle-shaped supporting side walls with smooth transitions. The first sealing edge 1 is shown as a substantially vertical sealing whereas the second sealing edge 2 forms a substantially horizontal sealing. The pouch 10 can have the shape of a stretched tetrahedron or polyhedron with four triangular stretched side walls. The triangular planes 11, 12, 13, 14 form basically the side walls.

The pouch 10 can be created in production from a quadrilateral base area or material formed to a cylinder or tube that is sealed along the longitudinal sealing 7. Theoretically, one open side of the cylinder is then closed to the first sealing edge 1 and the other open side is closed to the second sealing edge 2. The first sealing edge 1 and the second sealing edge 2 are arranged substantially at right angles to each other.

Figure 3:
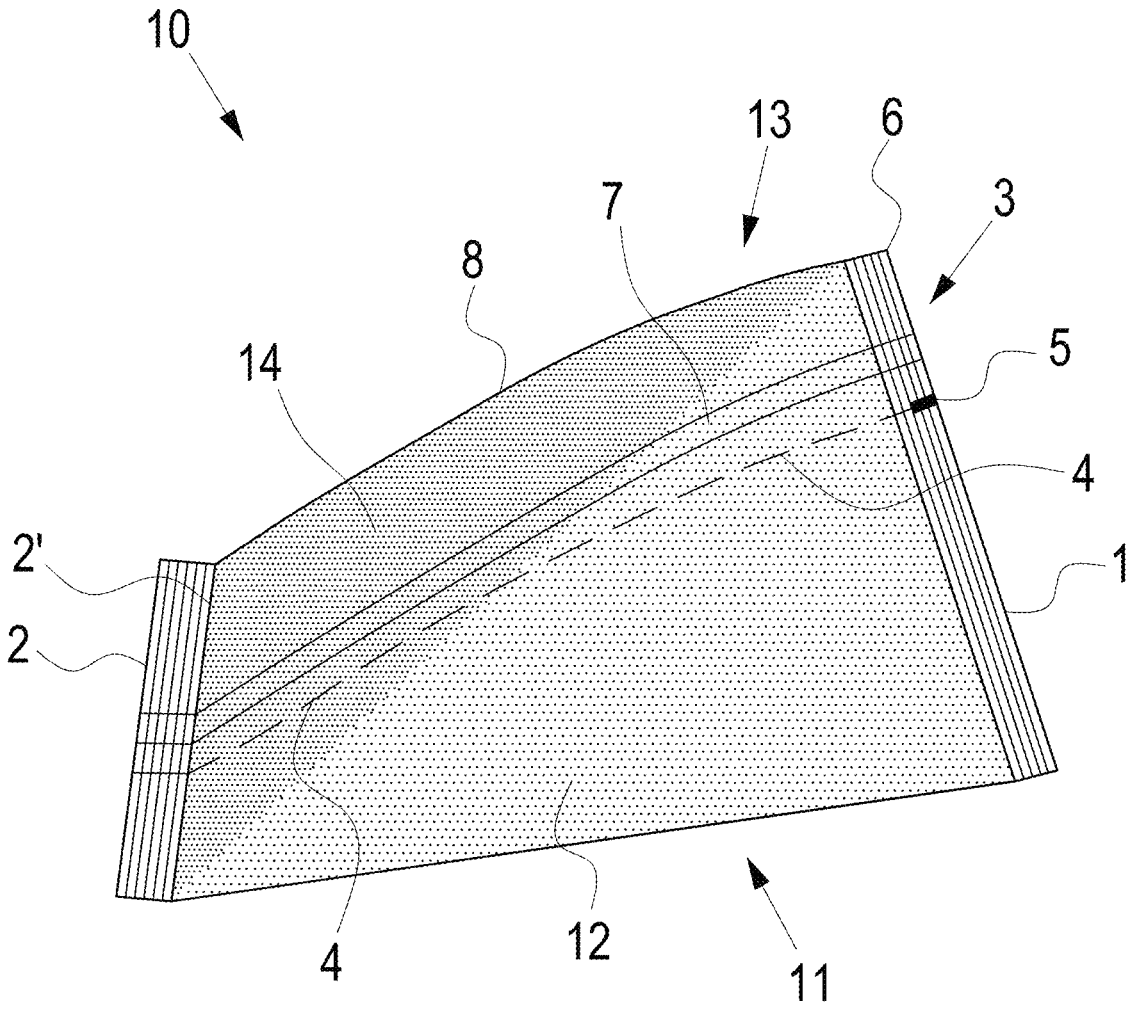
FIG. 3 shows a schematic representation of another pyramidal shaped pouch.

FIG. 3 shows a schematic representation of another pyramidal shaped pouch 10 that basically is mirrored. The pouch 10 is closed, filled with the food product, and placed on a horizontal plane before opening. The pouch 10 comprises here the first sealing edge 1 on the right-hand side and the second sealing edge 2 on the left-hand side. The first sealing edge 1 is vertically and the second sealing edge 2 horizontally arranged. The first sealing edge 1 and the second sealing edge 2 are arranged substantially orthogonally to each other to form in between the pouch 10 that contains the food product. The pouch 10 has the tear area 4, 5 that extends along the longitudinal sealing 7. The force insertion area 3 is here on the right-hand side substantially near to the apex 6 at the side of the first sealing edge 1, where also the longitudinal sealing 7 intersects. As will be shown in FIGS. 5 and 6, after two pouches 10, the production process repeats, which means that pouches 10 are produced where for the first pouch the longitudinal sealing 7 is on one side whereas for the second pouch the longitudinal sealing 7 is on the other side.

The notch 5 provides the direction or guidance to which an end user applies tensile or pulling forces when opening the pouch 10. Advantageously, the notch 5 is arranged near where the pouch 10 is sealed or welted along the longitudinal sealing 7 between the first sealing edge 1 and the second sealing edge 2.

An embodiment of the pouch 10 may have the following dimensions. The first sealing edge 1 is about 100 mm and the second sealing edge 2 is 100 mm in length too. Each sealing at the vertical and horizontal edges 1, 2 has a width of about 15 mm that can also be referred to as fin having a rectangular area of 100 mm by 15 mm. The fin can have a wavelike structure that is created during the sealing process or wrinkle welding. Small rills running along the longitudinal direction of each sealing edge 1, 2 can form the wavelike structure. The outer side of each edge 1, 2 can be serrated. This is from the manufacturing process and the cutting to individual pouches 10. From the vertex corner at the first sealing edge 1 of the pyramidal shaped pouch 10 to another vertex corner at the second sealing edge 2 the length is about 190 mm. From the inner part of each sealing edge 1, 2 the length is about 160 mm.

The first triangular plane 11, the second triangular plane 12, the third triangular plane 13, and the fourth triangular plane 14 merge into each other without defined edges to form the pouch 10. Each triangular stretched face or triangular plane 11, 12, 13, 14 forms an isosceles triangle-shaped supporting side wall. Each side wall of the pouch 10 is substantially an isosceles triangle with two sides, each of about 160 mm, and the remaining side of about 100 mm.

Such pouch 10 would have a filling weight of about 60-70 grams and a volume of approximately 340-380 ccm. The size of the pouch 10 can vary. Thus, pouches 10 can be smaller or larger. Also, other geometries might be possible as the invention is not limited to pyramidal shaped pouches. The pyramidal shaped pouch can have one or more apexes or corners where one or more are beveled or broken off.

The described pouch 10 with some attachment means could serve as a holder or support for a smartphone or smartphone like device. Adhesive pieces or tapes may be provided to fix the smartphone to the pouch 10 in an inclined position to enable best use and visibility. Also, once opened and emptied of their contents, instead of being discarded, used pouches can also be used as birthday party hats for small caged animals such as pet hamsters.

Figure 4:
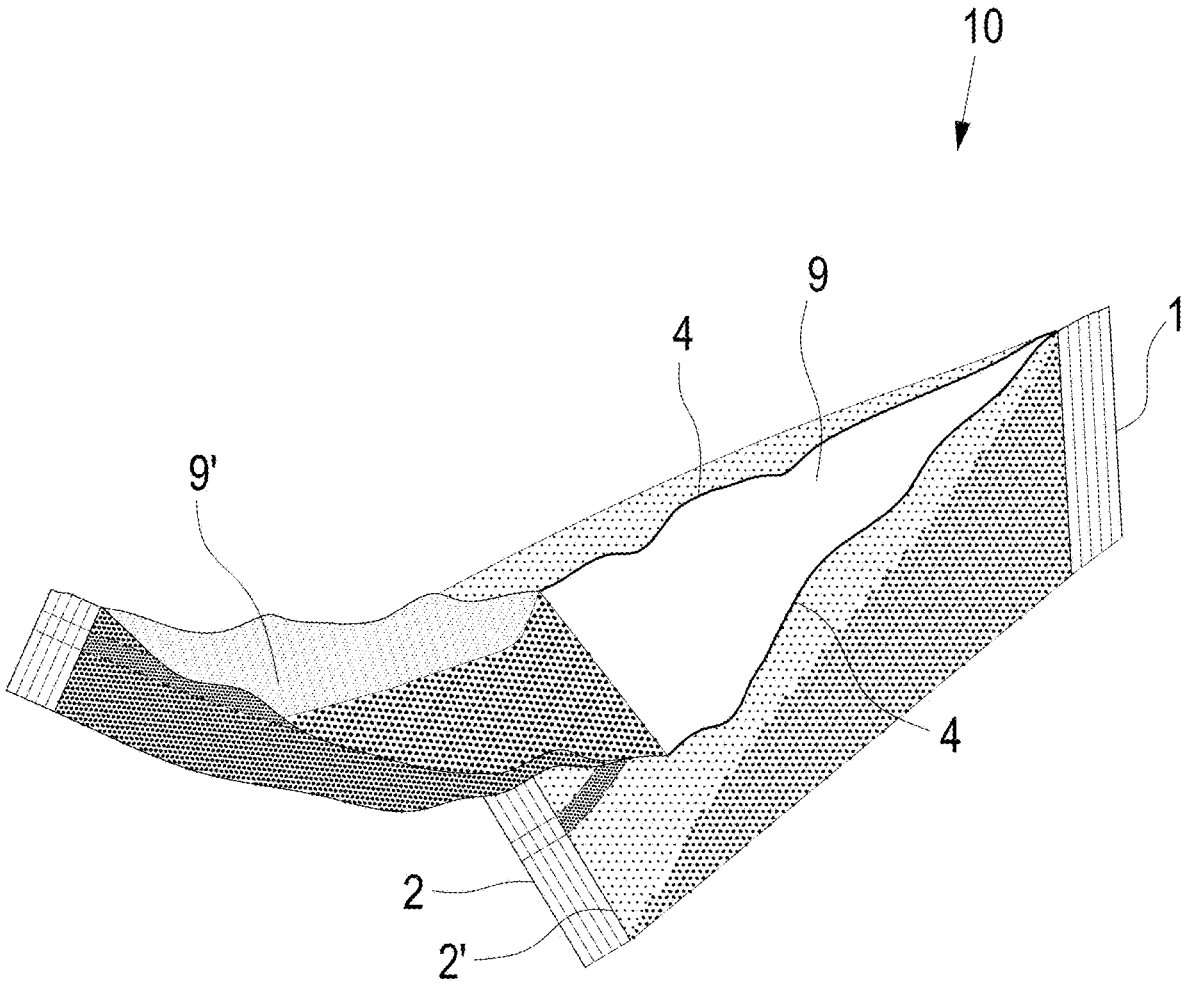
FIG. 4 shows a schematic representation of the pyramidal shaped pouch of FIG. 3 after opening in accordance with one embodiment.

FIG. 4 shows one embodiment after opening with a triangular opening 9 and a tear-off part 9'. The triangular opening 9 runs inclined along the tear edge 4 from the upper part of the vertically oriented first sealing edge 1 to the inner side 2' of the horizontally oriented second sealing edge 2. The tear-off part 9' can be swung out or opened up to the left-hand side but left attached near the inner side 2'. It is also possible to open the pouch 10 partly or half way. The triangular opening 9 releases approximately half of the side length of the second sealing edge 2. The food product is now released and ready for use.

The pouch 10 forms a bowl-shaped receptacle that provides easy access to the food product, preferably snacks such as sunflower seeds or roasted sunflower seeds. The opened pouch 10 can be positioned on a plane or table for display of the food product, which is ready for consumption.

Figure 7C:
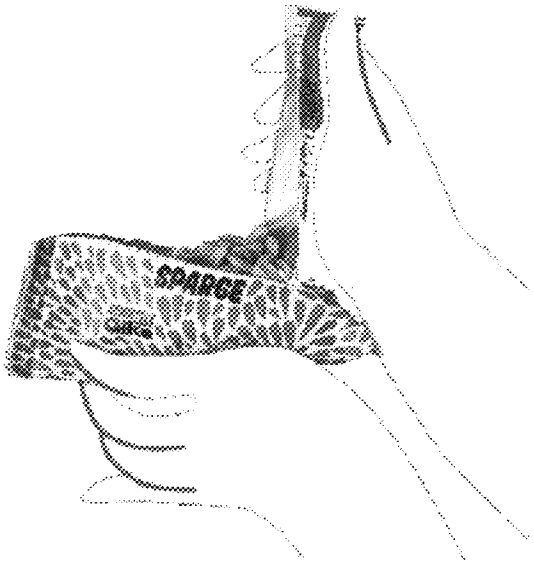
FIGS. 7A-C illustrate how a user can open the pouch to access the food product inside.
Figure 7B:
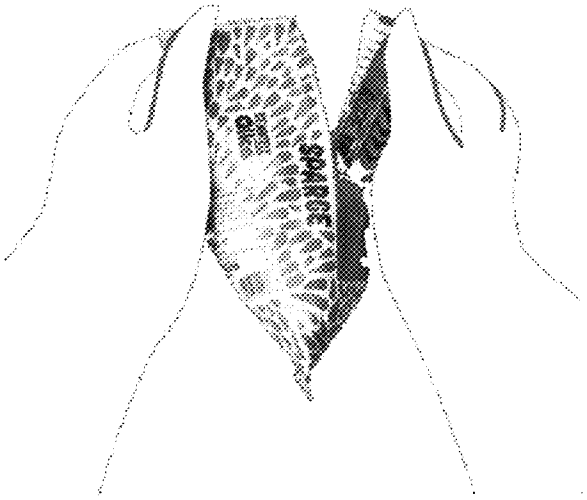
Figure 7A:
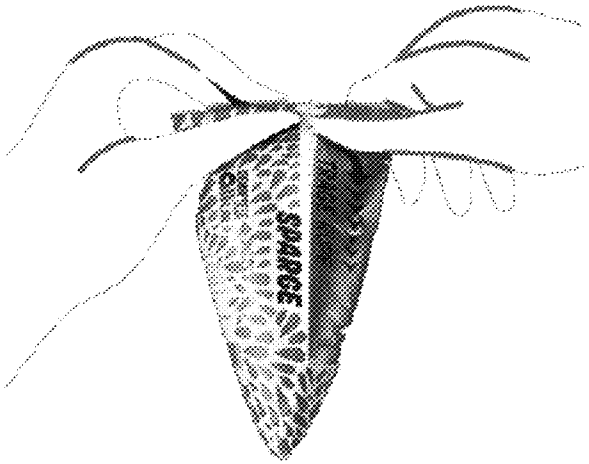

FIGS. 7A-C illustrate how a user can open the pouch 10 to access the food product inside. FIG. 7A shows the user grasping the first sealing edge 1 with opposite hands on opposite sides of the notch 5 to initiate a tear open of the pouch. FIG. 7B shows the user pulling the tear off part 9' away from the pouch body as the pouch tears along the longitudinal sealing 7 on one side of the triangular opening 9 and symmetrically on another side of the triangular opening 9. FIG. 7C shows the user holding the opened pouch 10 showing the contents inside.

When opening the pyramidal shaped pouch 10 to release the food product, a tensile or pulling force is applied to the tear area 4, 5 (shown in FIGS. 1, 2, and 3) in the direction from the first sealing edge 1 to the second sealing edge 2 thereby opening the pouch 10 along the tear edge 4 near the longitudinal sealing 7. The longitudinal sealing 7 can be configured to pull away with the tear-off part 9'.

To open the pouch 10, the sealing edge 1 is grasped by the fingers in the holding areas and near the notch 5, and is torn-off from the first sealing edge 1 towards to the second sealing edge 2 on the other side. This opens the pouch 10 along the tear edge 4 proper and due to the force symmetry, the tear on both sides will be nearly identical. The pouch 10 after opening includes the tear-off element 9' with a substantially rectangular shape and a triangular end. The tear-off part 9' remains attached to the pouch 10.

The pouch 10 can be opened while positioned on a table or holding in the hands. The first sealing edge 1 is then vertical while the second sealing edge 2 is horizontally and nearly parallel to the table.

A preferred way to open the pouch 10 is to hold the first sealing edge 1 horizontally at the top while the second sealing edge 2 is at the bottom. In other words, the tip of the second triangular plane 12 or triangle-shaped supporting side wall is at the bottom. The fingers hold the pouch 10 near the tear notch 5 and apply an opposing tractive force. While applying the force the pouch 10 opens along the tear edge 4 guided by the longitudinal sealing 7. The pouch 10 is then slightly pivoted to one side such that no content falls out. After swiveling the pouch less than 90° the horizontal first sealing edge 1 is then nearly vertical, but slightly inclined. The pouch 10 is then opened and can be placed with its triangular base area on a horizontal plane, like a table or the like. Alternatively, the opened pouch 10 might be held in one's hand.

The triangular opening 9 forms substantially an isosceles triangle with two sides of equal length, one side straighter, the other slightly more curved, and the remaining side holding the tear-off part 9'. The straighter side is there where the opening runs along the sealing 7 whereas the more curved or serrated side runs through the material without such guidance, but still controlled from the other side.

Figure 5:
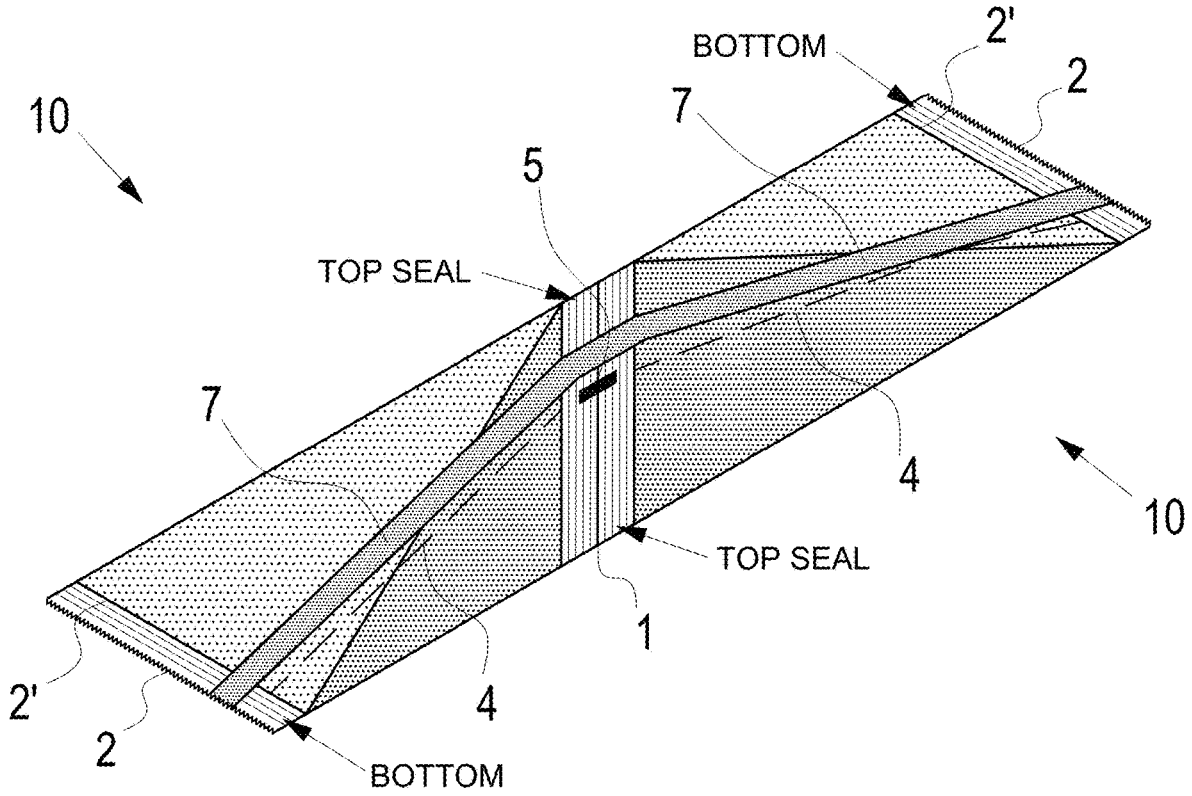
FIG. 5 shows a simulation for the production of pyramidal shaped pouches.

FIG. 5 shows a simulation for the production of pyramidal shaped pouches 10 where one pouch 10 follows the next pouch 10. Along the respective edge 1, 2, the pouches are cut into individual pouches. FIG. 5 shows the longitudinal sealing 7 where the tear edge 4 will run close to the sealing after opening the pouch 10. The longitudinal sealing 7 runs through from one pouch 10 to the next pouch 10. Near where the longitudinal sealing 7 meets with the first sealing edge 1, the notch 5, here also referred to as tear notch, is created. At each edge 1, 2, each pouch 10 is cut from the next pouch 10, respectively.

Figure 6:
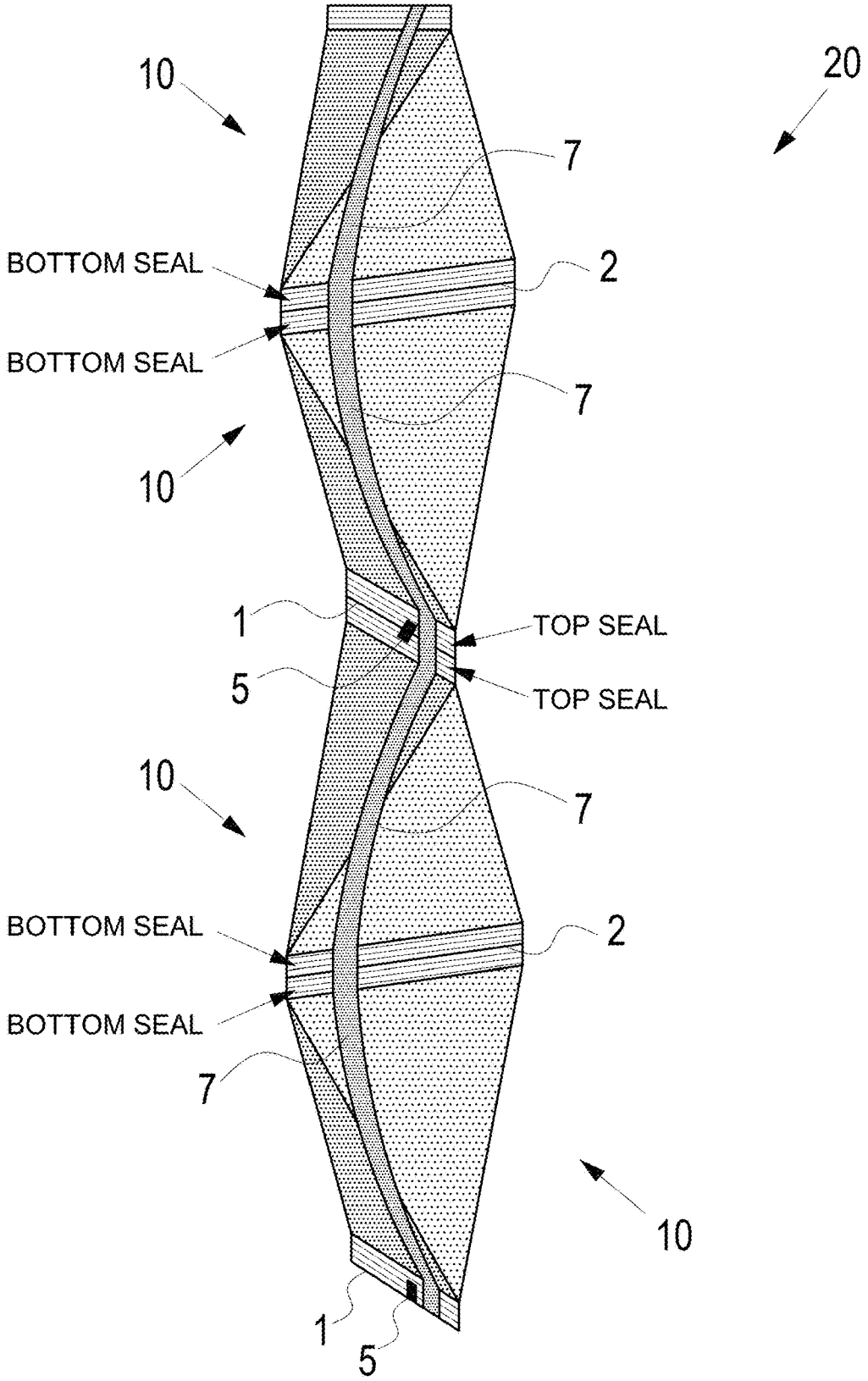
FIG. 6 shows a further simulation for the production of pyramidal shaped pouches.

FIG. 6 shows a further simulation for the production of pyramidal shaped pouches 10. Nearly four three-dimensional pouches 10 are shown vertically, while the top pouch 10 is not shown in full. The production of the pouches 10 can run through an automatic machine (not shown) working in the process of form, fill, and seal, and then repeat. Such machine forms the pouches 10 from a roll of flexible material that is already printed. The pouch 10 consists of heat-sealable laminates with aluminum having a desired tear characteristic. The first sealing edge 1 is here also referred to as top seal whereas the second sealing edge 2 is referred to as bottom seal. The longitudinal sealing 7 runs through from one pouch 10 to the next.

For the production of the pyramidal shaped pouches 10 from a roll, a quadrilateral base of the multi-layered heat sealable material is provided and formed to a tube 20. Then, where the material overlaps, the longitudinal sealing 7 is formed by a sealing technique. Next, across the tube 20, the first sealing edge 1 is generated by the same or a different sealing technique. The first sealing edge 1 is basically the first sealing edge for two pouches 10 as it is indicated in FIG. 6. Then, across the tube 20 in a perpendicular direction, the second sealing edge 2 is generated, preferably by the same sealing technique as used for the first sealing edge 1. The second sealing edge 2 is also the sealing edge for two pouches 10 and so on. Finally, a tear area 4, 5, extending substantially along the longitudinal sealing 7 for generating an opening 9, is provided. The notch 5 allows tensile forces to be applied in a controlled manner such that the guided tear edge 4 for opening the pouch 10 is created. As each of the first sealing edge 1 and the second sealing edge 2 is the edge of two pouches, a cutting step along the edges separates or disjoins the pouches into individual pouches 10. During the production process and before finally sealing the pouch 10, each pouch 10 is filled with the food product.

Figure 8A:
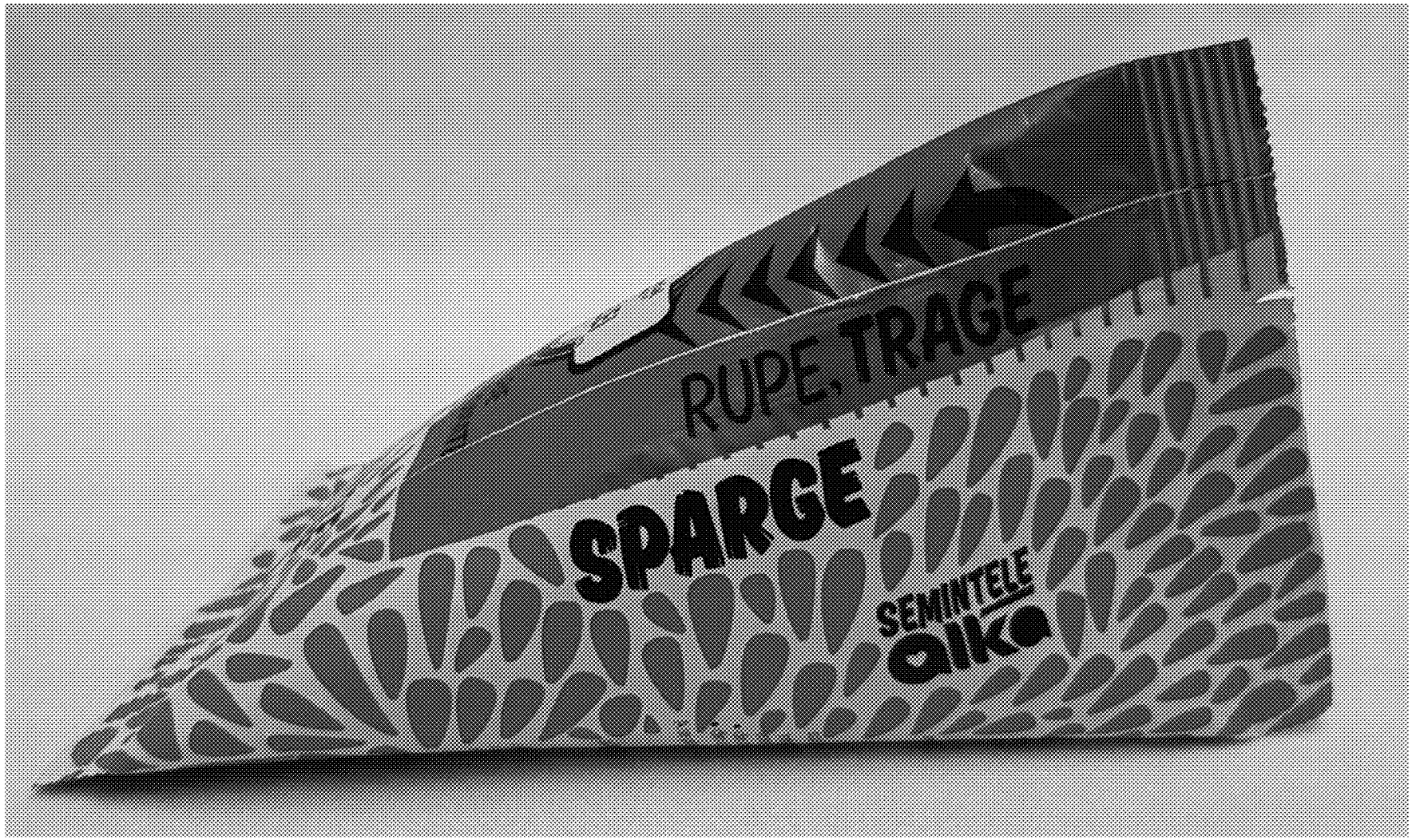
FIGS. 8A-C are photographs from three perspectives of a pouch in accordance with one embodiment.
Figure 8B:
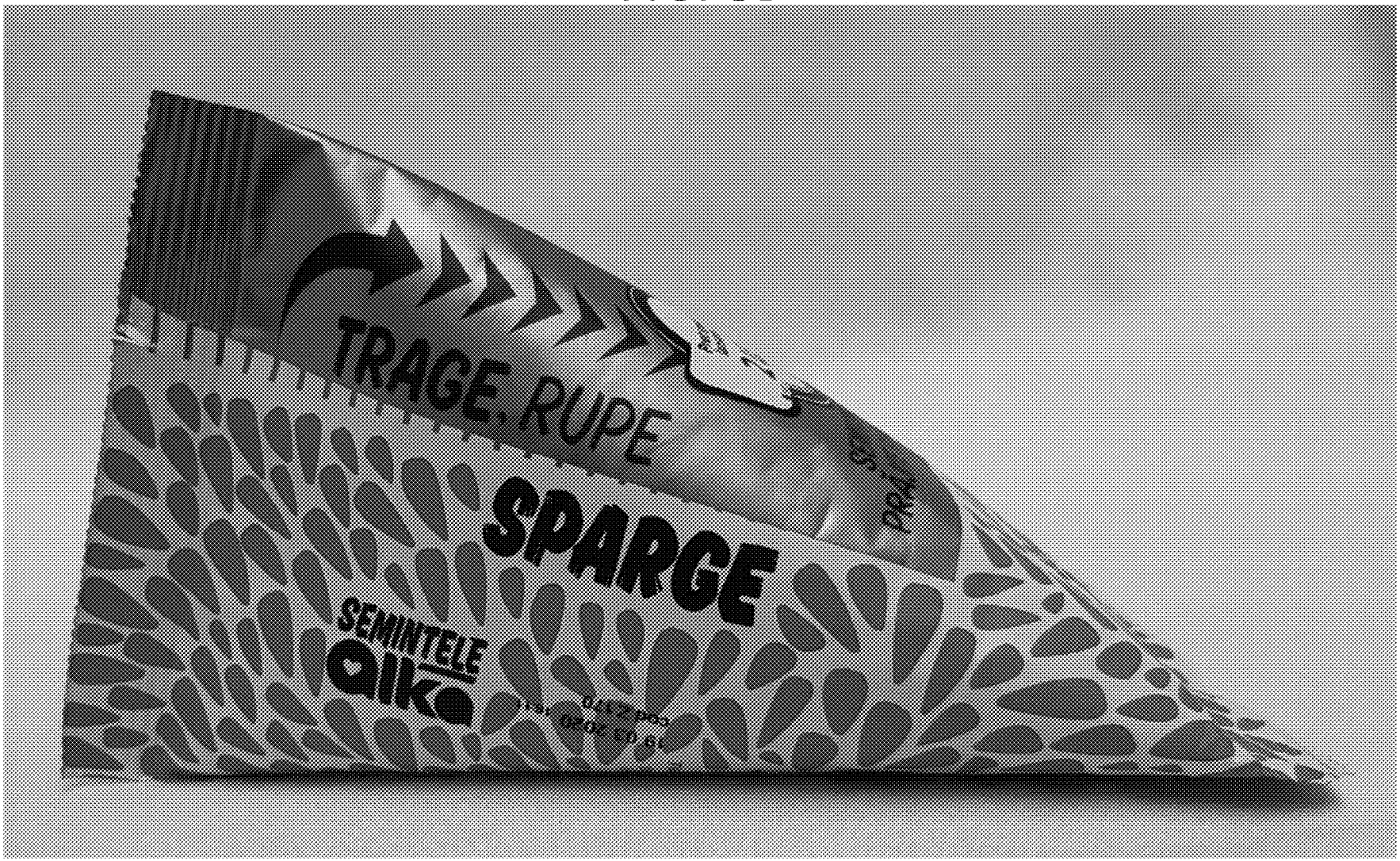
Figure 8C:
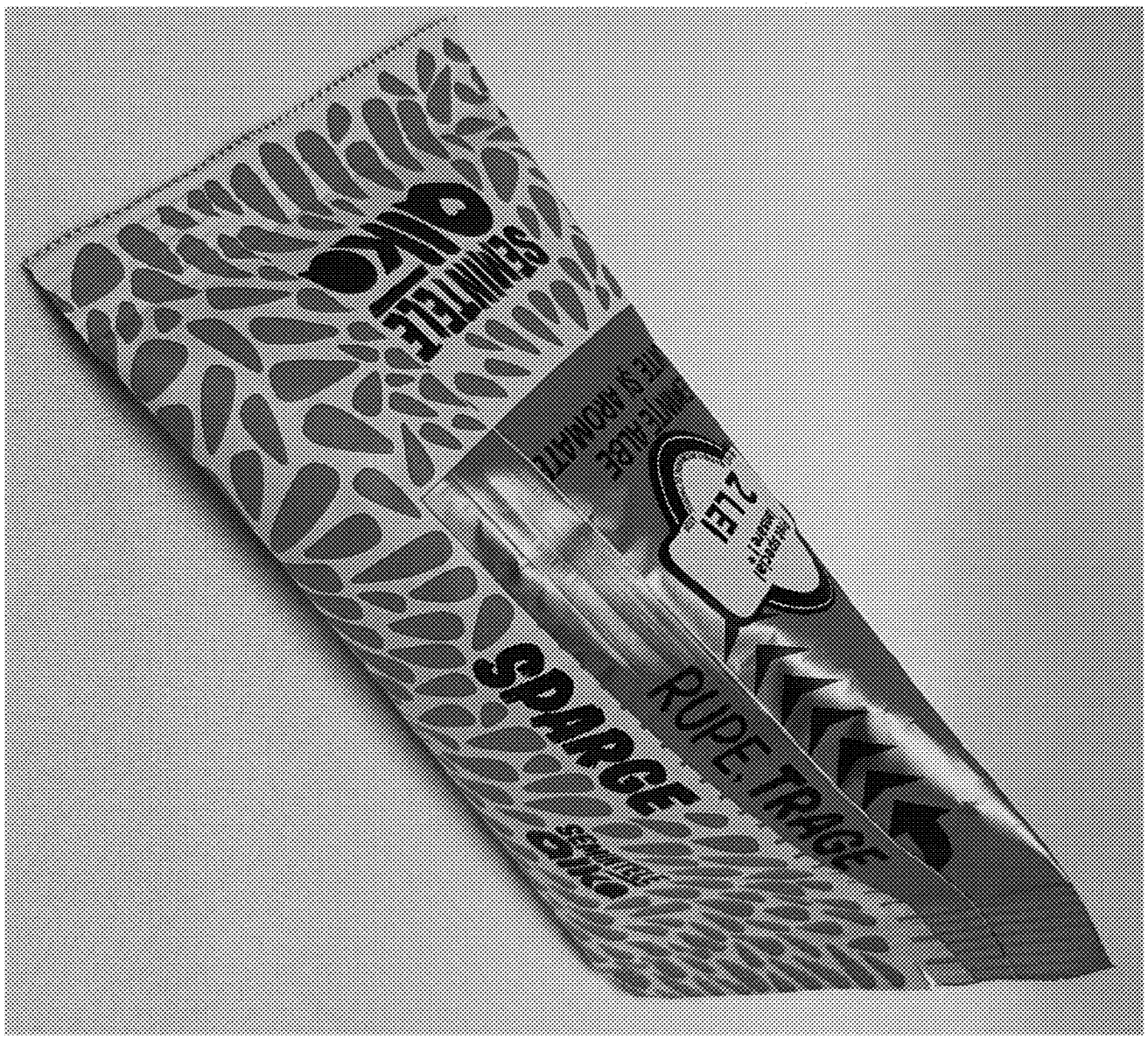

FIGS. 8A-C are photographs from three perspectives of a pouch in accordance with one embodiment.

Aspects of Various Embodiments

Disclosed is a pyramidal shaped pouch for a food product. The pouch comprises a first sealing edge and a second sealing edge arranged substantially orthogonally to each other to form in between the pouch suitable to receive the food product. The pouch comprises further a tear area extending substantially along a longitudinal sealing for generating an opening.

It is an object to provide an easy to open pouch for food products, such as snacks or the like. After opening, the pouch should provide a stable container or reservoir to provide free and simple access to the pouch's content.

It is another object to provide a method for easy opening of a food pouch.

It is yet another object to provide a method for producing a food pouch.

These and other objects are achieved by an inventive pouch and an inventive method according to the independent claim. Other preferred embodiments are indicated in the dependent claims.

A first aspect relates to a pouch for a food product or generally to food packaging. The pouch is particularly suitable for a sunflower seed package. The pouch comprises a first sealing edge and a second sealing edge arranged substantially orthogonally to each other to form in between the pouch suitable to receive the food product. The pouch further comprises a tear area extending substantially along a longitudinal sealing for generating an opening. The opening allows an easy and wide access to the pouch's content, which can be snacks, like sunflowers, nuts, mixes of nuts, chips, pistachios, or any other edible seed or food. The pouch may contain any type of food to which easy access is desired.

The pouch preferably has a pyramidal shape that is asymmetric. The pouch has the shape of a stretched tetrahedron, that is a polyhedron composed of four triangular stretched faces, six straight edges, and four vertex corners. The first sealing edge and the second sealing edge are basically perpendicular to each other.

The pouch basically comprises a first triangular plane, a second triangular plane, a third triangular plane, and a fourth triangular plane. All planes merge into each other without folding edges to form the pouch. The triangular planes form isosceles triangle-shaped supporting side walls. The first sealing edge forms a substantially vertical sealing whereas the second sealing edge forms a substantially horizontal sealing when the pyramidal shaped pouch is arranged horizontally.

The tear area, also referred to as tear open element, is partly defined by a notch formed within or cut into the first sealing edge. During production a cut or slit is made into the sealing edge such that the notch forms a recess that extends substantially orthogonally into the pouch material. The notch is advantageously arranged near the longitudinal sealing or welding in the upper part or closer to an end of the first sealing edge. The notch extents approximately one third into the first sealing edge, also referred to as top seal, which provides enough width to guide the tear further. Basically, the notch is arranged opposite of the longitudinal sealing towards the longitudinal middle of the first sealing edge.

One side of the tear area extends along the longitudinal sealing, thereby defining a guided tear edge on both sides. The longitudinal sealing is, however, only on one side.

The longitudinal sealing extends between the first sealing edge and the second sealing edge, where it runs substantially near to a pouch side edge. The longitudinal sealing can be folded away from the tear area, in other words the material is folded towards the closest side edge of the pouch. Thus, along the longitudinal sealing the material is thicker and provides a guided tear area. It is advantageous to arrange the longitudinal sealing asymmetrically to generate the desired tear or opening effect.

In between the first sealing edge and the second sealing edge, the tear area extends along a line to form or generate the tear edge near where the pouch is sealed or welted between the first sealing edge and the second sealing edge. The pouch has there the longitudinal sealing that extends between the first sealing edge and the second sealing edge. The longitudinal sealing can be positioned out of center which advantageously ensures the opening of the pouch through guidance starting from the tear notch at the first sealing edge and going straight towards or near the second sealing edge at the bottom. As indicated, the material is thicker there as it is "folded right over left" and sealed. Thus, a defined tear line or tear edge is provided that is not running into the thicker part, rather it is guided. In other words, the line or tear line before opening is a virtual line that is not directly defined, but the direction is given. The notch is predefined whereas the rest of the tear area runs as a tear edge along the line that is restricted by the sealed or welted thicker part. When a tensile force acts, it is guided along the line or tear edge, but not into the longitudinal sealing. This allows and creates a smooth and straight opening of the pouch.

The pouch can be formed from a material that is multi-layered and provides the desired tear characteristic. A flexible material that is heat sealable can be used. It can be printed on the outside to describe the content or other facts. It is preferred to apply a film material that comprises aluminum to achieve a given material stiffness. The tear line guidance of the tear area, in particular the tear edge, can be influenced by the chosen material, by chemical and physical features of the material, or the treatment of the material. The application of a laser during the production process to weaken certain areas of the pouch might be an alternative to provide a guided tear experience.

The pouch forms, after opening, a bowl-shaped receptacle that provides access to the food product. This has besides optical or esthetical aspect most notably practical aspects. The opened pouch is in a stable position and allows a wide and easy access to the content. What is particularly advantageous is that no further rustling is generated when content is taken out. With conventional pouches, rustle and sizzling noise is generated continuously when content is taken out. This is often perceived as unpleasant.

The resulting opening is substantially a triangular opening. The pouch's triangular opening forms substantially an isosceles triangle. That means that the opening has two sides of equal length, one side is nearly straight whereas the other is more or less slightly curved. The remaining side holds advantageously the tear-off part. The tear-off part may remain on the pouch and thus cannot get lost. The tear-off part may be later or after a part consumption of the content pushed back into its original position. Adhesive pieces or tapes may be provided to fix the tear-off part back to the pouch.

When the substantially triangular opening runs from the first sealing edge to substantially an inner part of the second sealing edge, then the pouch opens widely and provides access to the content over nearly the whole length.

The pouch comprises a force insertion area substantially near to an apex or vertex corner at the side of the first sealing edge where the longitudinal sealing intersects. In combination with the notch, this is a preferred area to insert forces. This is practically near a holding area where a user or consumer of the pouch would hold the pouch for opening.

When the pouch is placed or arranged on a horizontal plane, the substantially triangular opening runs slightly oblique from the first sealing edge that then is vertically arranged to the second sealing edge that is horizontally arranged. This looks nice and allows easy removal of the content from the top or side.

The substantially triangular opening releases approximately 50% of the side length of the second sealing edge, allowing a wide access to the pouch's content.

The pouch after opening comprises a tear-off element with a substantially rectangular shape and a triangular end. That is the tear-off part that remains attached to the pouch. This is advantageous if the pouch later should be reclosed. For that, a closing mechanism or means like adhesive tapes or the like can be provided. For opening and/or closing a zipper like mechanism could be used.

Another aspect relates to a method for opening a pouch that is preferably pyramidal shaped and contains a food product. The pouch has a first sealing edge and a second sealing edge arranged substantially orthogonally to each other to form in between the pouch suitable to receive the food product. The pouch has further a tear area extending substantially along a longitudinal sealing for generating an opening that preferably results in a substantially triangular opening. The method comprises the step of applying at a force insertion area a tensile force to the tear area in the direction from the first sealing edge to the second sealing edge thereby opening the pouch along a tear edge substantially near the longitudinal sealing. Due to a force symmetry, both sides are opened along the tear edge almost identically.

Before the pouch is created or produced it can be described as a quadrilateral base area that is formed to a cylinder or tube. Theoretically, one open side of the cylinder is closed to the first sealing edge and the other open side of the cylinder is closed to the second sealing edge.

A further aspect relates to a method for producing a pyramidal shaped pouch for receiving a food product. The production method comprises the steps of providing a quadrilateral base of a multi-layered heat sealable material and forming a tube from the material; sealing along the longitudinal direction where the material overlaps to form a longitudinal sealing; sealing across the tube to generate a first sealing edge; the first sealing edge being the first sealing edge for two pouches; sealing across the tube to generate a second sealing edge perpendicular to the first sealing edge; the second sealing edge being the second sealing edge for two pouches; and providing a tear area extending substantially along the longitudinal sealing for generating an opening. As each of the first sealing edge and the second sealing edge is the edge of two pouches, a cutting step separates or disjoins the pouches to individual pouches.

During the production process, each pouch is filled with the food product.

LIST OF REFERENCE NUMERALS

1 first sealing edge
2 second sealing edge
2' inner part of the second sealing edge
3 force insertion area
4, 5 tear area with tear edge and notch
4 tear edge
5 notch
6 apex
7 sealing
8 pouch side edge
9 opening
9' tear-off part
10 pouch
11 first triangular plane
12 second triangular plane
13 third triangular plane
14 fourth triangular plane
20 tube

The invention claimed is:

1. A pouch for a food product comprising:

a side wall comprising a tubular section of heat-sealable laminate material having a tear characteristic;

a first sealing edge extending laterally across a first flattened and cut end section of the tubular section of material;

a second sealing edge extending laterally across a second flattened and cut end section of the tubular section of material opposite the first flattened and cut end section of the tubular section of material, the second sealing edge arranged substantially orthogonally to the first sealing edge;

a notch in and running substantially perpendicular to the first sealing edge to facilitate tearing the pouch starting at the first sealing edge and along two lower tear edges in the side wall to form, based on the tear characteristic and a position of the notch within the first sealing edge, a substantially triangular tear area in the side wall having an apex at the first sealing edge and a base extending along a resulting fold extending between an end of each lower tear edge in the side wall, the tearing of the pouch generating a tear off part including a portion of the side wall and a portion of the first sealing edge adjacent the notch, the tear off part having a substantially triangular tear area with an apex at the notch in the first sealing edge and extending along two upper tear edges in the side wall to meet the base extending along the resulting fold, the upper and lower tear edges being complimentary and formed by tearing the pouch.

2. The pouch of claim 1, wherein the pouch after opening forms a bowl-shaped receptacle that provides access to the food product.

3. The pouch of claim 1, wherein the pouch is tetrahedral shaped.

4. The pouch of claim 1, wherein the side wall comprises a material that is multi-layered and heat sealable.

5. The pouch of claim 4, wherein the side wall comprises aluminum.

6. The pouch of claim 1, wherein the tear area is substantially in a shape of an isosceles triangle.

7. The pouch of claim 1, wherein the tear area runs from the first sealing edge to substantially an inner part of the second sealing edge.

8. The pouch of claim 1, wherein the tear area runs slightly oblique from the first sealing edge being vertically arranged to the second sealing edge being horizontally arranged when the pouch is placed on a horizontal plane.

9. The pouch of claim 1, wherein the tear area releases approximately one half of a side length of the second sealing edge.

10. The pouch of claim 1, wherein the tear off part is substantially tetrahedral in shape.

11. The pouch of claim 1:

wherein the tubular section of heat-sealable laminate material has been formed by bringing together, overlapping and sealing together longitudinal edge sections of a sheet of packaging material to form a longitudinal sealing;

wherein the first sealing edge is arranged substantially orthogonally to the longitudinal sealing;

wherein the second sealing edge is arranged substantially orthogonally to the longitudinal sealing; and wherein the notch in the first sealing edge is adjacent the longitudinal sealing.

12. The pouch of claim 11, wherein the longitudinal sealing is folded away from the tear area.

13. The pouch of claim 11, wherein the longitudinal sealing is arranged asymmetrically.

14. The pouch of claim 11, wherein the longitudinal sealing extends between the first sealing edge and the second sealing edge, the longitudinal sealing being substantially near to a pouch side edge.

15. The pouch of claim 11, wherein the notch is arranged near the longitudinal sealing and extends approximately one third into an area extending from the first sealing edge.

16. The pouch of claim 11, wherein the notch is arranged opposite of the longitudinal sealing towards a longitudinal middle of the first sealing edge.

17. The pouch of claim 11, wherein the tear area extends substantially parallel to the longitudinal sealing.

18. The pouch of claim 11, further comprising a force insertion area substantially near to an apex at a side of the first sealing edge where the longitudinal sealing intersects.

19. The pouch of claim 11, wherein in between the first sealing edge and the second sealing edge, the tear area extends along a line to generate a tear edge substantially near and along the longitudinal sealing.

20. A method for producing pyramidal shaped pouches for receiving a food product, the method comprising:

providing a quadrilateral base of a multi-layered heat sealable material and forming a tube from the material;

sealing along a longitudinal direction where the material overlaps to form a longitudinal sealing;

sealing across the tube to generate a first sealing edge, the first sealing edge being a first sealing edge for both of two adjacent pouches;

sealing across the tube to generate a second sealing edge substantially orthogonally to the first sealing edge, the second sealing edge being a second sealing edge for one of the two pouches;

sealing across the tube to generate a third sealing edge substantially orthogonally to the first sealing edge, the third sealing edge being a second sealing edge for another of the two pouches;

creating a notch in the first sealing edge adjacent the longitudinal sealing to form a tear area for generating an opening on each of the two adjacent pouches, the tear area extending substantially along the longitudinal sealing; and cutting laterally along the first sealing edge to separate the two adjacent pouches.

* * * * *